US006536175B2

(12) United States Patent
Conterno

(10) Patent No.: US 6,536,175 B2
(45) Date of Patent: Mar. 25, 2003

(54) ASSEMBLY OF PANELS AND JOINTING ELEMENTS

(75) Inventor: Cosimo Conterno, Mendrisio (CH)

(73) Assignee: Politec Polimeri Tecnici S.A., Stabio (CH)

( * ) Notice: Subject to any disclaimer, the term of this patent is extended or adjusted under 35 U.S.C. 154(b) by 0 days.

(21) Appl. No.: 09/798,696

(22) Filed: Mar. 2, 2001

(65) Prior Publication Data

US 2001/0022058 A1 Sep. 20, 2001

(30) Foreign Application Priority Data

Mar. 7, 2000 (IT) ..... MI00A0438

(51) Int. Cl.[7] ..... E04C 2/54; E04D 3/06

(52) U.S. Cl. ..... 52/489.1; 52/584.1; 52/582.1; 52/483.1; 52/762

(58) Field of Search ..... 52/582.1, 584.1, 52/483.1, 489.1, 762, 763, 773, 774, 780

(56) References Cited

U.S. PATENT DOCUMENTS

| | | | | | |
|---|---|---|---|---|---|
| 2,803,321 | A | * | 8/1957 | Fox-Williams | 52/773 X |
| 4,332,119 | A | * | 6/1982 | Toews | 52/762 X |
| 4,573,300 | A | * | 3/1986 | Bezner | 52/563 |
| 4,979,345 | A | * | 12/1990 | Celsi | 52/762 X |
| 4,998,395 | A | * | 3/1991 | Bezner | 52/563 X |
| 5,579,624 | A | * | 12/1996 | Aeberhard | 52/762 X |
| 5,580,620 | A | * | 12/1996 | Campbell et al. | 52/793.1 X |
| 5,644,878 | A | * | 7/1997 | Wehrmann | 52/483.1 X |
| 5,996,301 | A | * | 12/1999 | Conterno | 52/582.1 X |
| 6,164,024 | A | * | 12/2000 | Konstantin | 52/582.1 X |
| 6,233,886 | B1 | * | 5/2001 | Andres | 52/263 X |
| 6,347,495 | B1 | * | 2/2002 | Conterno | 52/483.1 |

FOREIGN PATENT DOCUMENTS

| | | | |
|---|---|---|---|
| EP | 050 462 | | 4/1982 |
| EP | 816 585 | | 1/1998 |
| EP | 0864708 | * | 9/1998 |
| EP | 865 724 | | 9/1998 |

* cited by examiner

*Primary Examiner*—Laura A. Callo
(74) *Attorney, Agent, or Firm*—Hedman & Costigan, P.C.

(57) ABSTRACT

An assembly of panels and jointing elements, in particular for the technical field of building, wherein each panel (11, 12), taken in section, comprises an alveolar structure, determined by a plurality of ribs (14) and arranged between two main outside surfaces (10, 28, 29), extensions (15, 16) obtained at opposed ends of each panel (11, 12), and a jointing element (13, 113) adapted to receive an extension (15, 16) of each of two adjacent panels (11, 12) firmly engaging them, wherein both each extension (15, 16) and the jointing element (13, 113) are provided with reciprocally engaged inclined surfaces (20, 21, 24, 25) facing inwards and facing each other, and wherein the jointing element (13) is U-shaped and is provided with a pressing element (19) that centrally extends inside it and arranges in wedged engagement between outside facing walls (17, 18) of the two extensions (15, 16).

8 Claims, 3 Drawing Sheets

ASSEMBLY OF PANELS AND JOINTING ELEMENTS

The present invention relates to an assembly of panels and jointing elements, in particular for the technical field of building.

In the building field, for example in roofing structures, wall plugs, protection walls and the like, the term "panels" indicates both actual panels and plates or walls, as well as similar elements that cooperate, in the example, to the realisation of such structures.

These panels, arranged in pair side-by-side along an end edge of both, are connected and made integral through "jointing elements" that couple the reciprocal edges and realise a firm and safe connection, thus making the structure integral.

Both panels and plates, and the jointing elements can be made of different materials, such as for example polycarbonate, aluminium or other specific resins.

In the building field, several panels and jointing elements have been realised so far and are known, of various types, which are made to cooperate with one another to try to realise assemblies of a certain value.

In fact, attempts have always been made to obtain assemblies of panels and jointing elements in the building field exhibiting features of lightness and of load capacity combined with as simplified structures as possible.

An example of solution for an assembly of panels and jointing elements for this purpose is described in the U.S. Pat. No. A-5.996.301. Some of these known assemblies exhibit a non-immediate and easy associability between the components; in fact, it is possible that a first panel may be easily inserted into the jointing element whereas a second panel may exhibit difficulties of insertion in the presence of the first inserted panel.

Another possible disadvantage is that, once panels and jointing element are connected, there is not a good seal between the parts, with the possibility—on the one side—of possible disengagement and, on the other side, of possible infiltrations in the assembly.

Another possible disadvantage that occurs in some of the known assemblies is that, by realising toothed connection portions, their construction is not so easy and their arrangement exhibits some difficulties, although not guaranteeing a safe stability and sometimes causing handling dangers for the presence of the sharp portions of the teeth.

Purpose of the present invention is that of providing an assembly of panels and jointing element in the building field which, although being particularly simplified in its structure, should allow an easy and immediate coupling between the panels and the jointing element.

Another purpose of the present invention is that of providing an assembly of panels and jointing element that should exhibit good resistance features, both general and at the jointing portion.

Another purpose of the present invention is that of providing an assembly of panels and jointing element that should ensure a firm arrangement between the parts, as well as a good seal against water and infiltrations. In any case, the assembly of the invention must allow the insulation to possible infiltrations due to accidental and unintentional reasons.

These and other purposes according to the present invention are obtained by realising an assembly of panels and jointing elements, in particular for the building field, as illustrated in claim 1.

Further features of the invention are object of the successive claims. The features and advantages of an assembly of panels and jointing elements according to the present invention will appear more clearly from the following exemplificative and non-limiting description made with reference to the attached schematic drawings. In such drawings:

Figure 1:
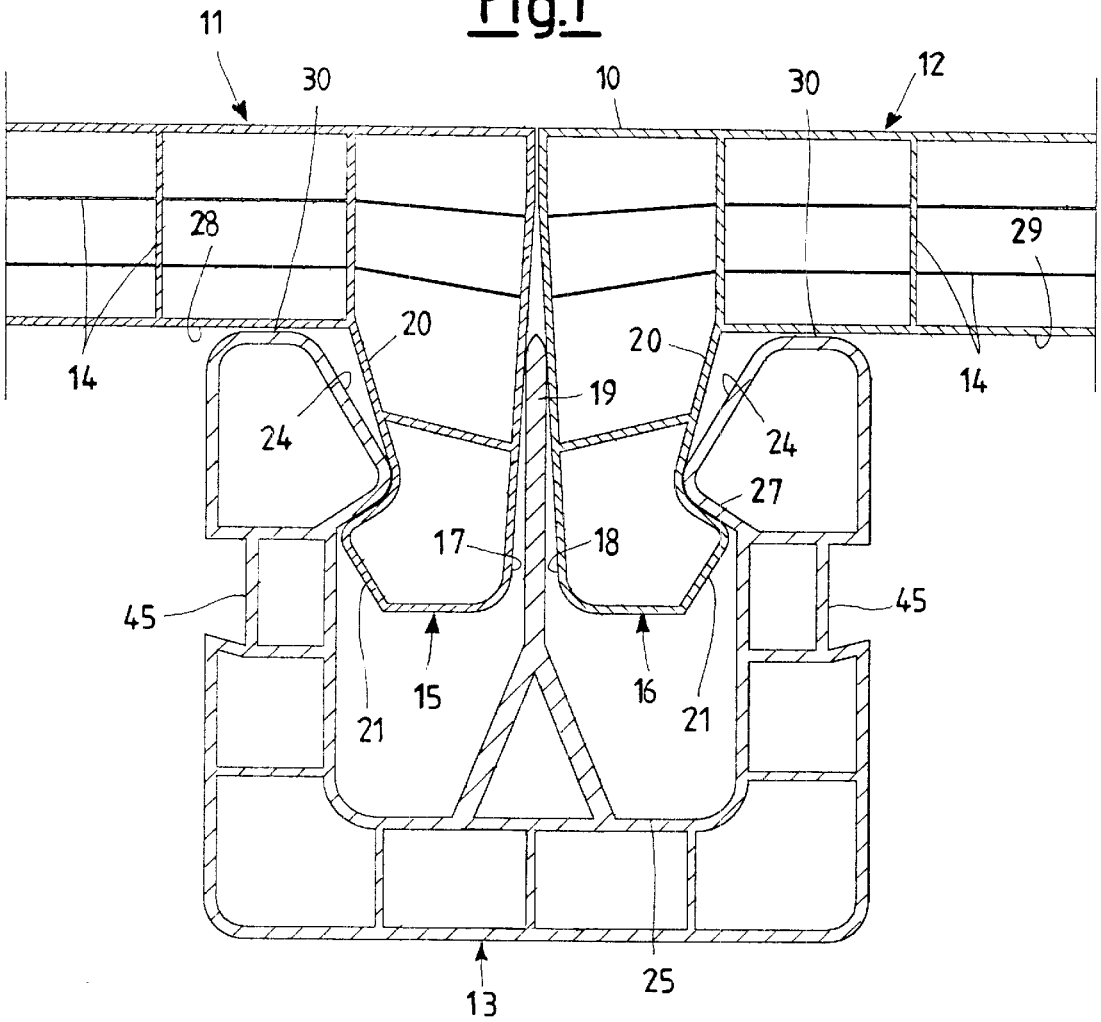
FIG. 1 shows a partial section view of a first embodiment of an assembly of panels and jointing element that realises the present invention, for example of polycarbonate.
Figure 3:
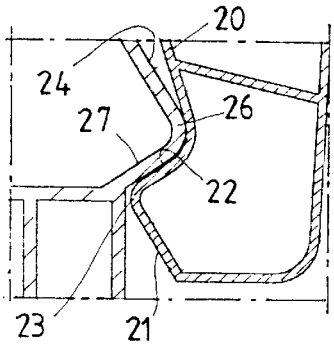
FIGS. 2 and 3 show sections of enlarged details of the assembly of FIG. 1.
Figure 2:
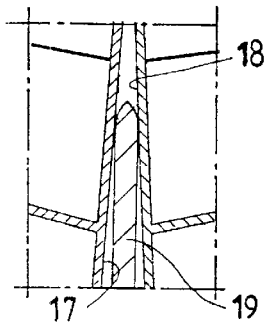

With reference to FIGS. 1–3, there is shown a first exemplification of an assembly of panels and jointing elements, in particular for the building field, according to the present invention.

In particular, in FIG. 1 there are shown two panels 11 and 12 connected to one another through a jointing element 13.

Panels 11 and 12 are made, for example, of polycarbonate, and they exhibit an alveolar structure determined by a plurality of ribs 14 of any type, arranged between the two main outside surfaces 10, 28, 29. In the example, such alveolar structure has a rectangular shape, thus providing a better thermal insulation and a higher resistance to loads, as well as a high flexibility. It must be noted that in this first example of embodiment of the assembly, also the jointing element 13 is made of polycarbonate, synthetic resin or other similar material.

The illustrated section shows the type of coupling that develops for the entire length of the two panels 11 and 12 to be connected, as well as the jointing element 13 that exhibits the same development and serves as upright. At the two opposed ends of each panel 11 and 12 there are provided enlarged-head extensions 15 and 16 with a tapered body towards the enlarged end (only one of which is shown for each panel). The two extensions 15 and 16 are arranged almost orthogonal with respect to a base of panel 11 or 12.

These extensions 15 and 16, as regards the tapered body, respectively exhibit an outside side surface 17 of panel 11 that faces surface 18 of the other panel 12, and both have a slight inclination towards the inside of the same panel.

This is for the purpose of facilitating their coupling with opposed faces of a pressing element 19, which centrally extends into the U-shaped jointing element 13, when the latter is arranged to constrain the two extensions 15 and 16 of different panels 11 and 12 in coupling.

Extensions 15 and 16, in the portion of their body facing the inside of each panel 11 and 12, exhibit a pair of portions with inclined surface 20 and 21 in the same direction as the tapering. The first portion with inclined surface 20 is arranged below the enlarged head, whereas the second portion with inclined surface 21 is directly obtained laterally to the same enlarged head.

Such two portions with inclined surface 20 and 21 are jointed to determine a housing 22, as well as a projection 23.

The two portions with inclined surface 20 and 21 facilitate the insertion of the single extension 15 and 16 into the jointing element 13, collaborating with an inclined surface portion 24 provided on each of the two extensions 15 and 16 and converging inwards and towards a central base 25 of the jointing element 13 of the assembly.

A projection or enlarged portion 26, radially protruding towards the inside of the jointing element 13 and provided with a rounded end, abuts into housing 22. Also such rounded end is determined by a pair of converging portions with inclined surface 24 and 27, extending from the two wings of the U inwards.

The inclined surface portion 24 is the one that facilitates the insertion of extension 15 and 16 in the jointing element 13, sliding on the inclined surface portion 21 of the same extensions.

As said, the jointing element 13 exhibits a U-shaped section, and it is obtained with an alveolar structure as well, and provided with a pressing element 19 which centrally extends into it.

Such pressing element 19 has a conical shape at the tip, which facilitates its insertion between the two extensions 15 and 16 of two sided panels 11 and 12 to be connected. Such conical shape guides the fixing and the arrangement of the two panels thanks to the collaboration with the two outside lateral surfaces 17 and 18 and of panels 11 and 12.

The shape of the inside of the jointing element 13 has already been described above.

The pressing element 19 cooperates to the arrangement and the holding of a first inserted panel 11, favouring the insertion operation of the second panel 12.

It must be considered that with both panels 11 and 12 inserted, the pressing element 19 exerts a force that presses inside surfaces 28 and 29 of the panels against outside faces 30 of the two wings of the jointing element 13. In this way, the seal is favoured with multiple contact surfaces (panel/junction, panel/presser).

Such seal between panel and pressing element is ensured by two friction surfaces whose perpendicular force is given by the presence of the same pressing element, as better visible in FIG. 2.

Moreover, an important fact consists in that the seal between panel 11, 12 and jointing element 13 is ensured by two portions with inclined surface, realised the first with the coupling of panel 11 or, 12, and the second with the inclined portion of the jointing element, as shown in FIG. 3.

In case of roofing or other similar application, such pressure engagement prevents water from entering into the assembly thus formed, maintaining the assembly totally impermeable to the water flowing on its surface.

Figure 4:
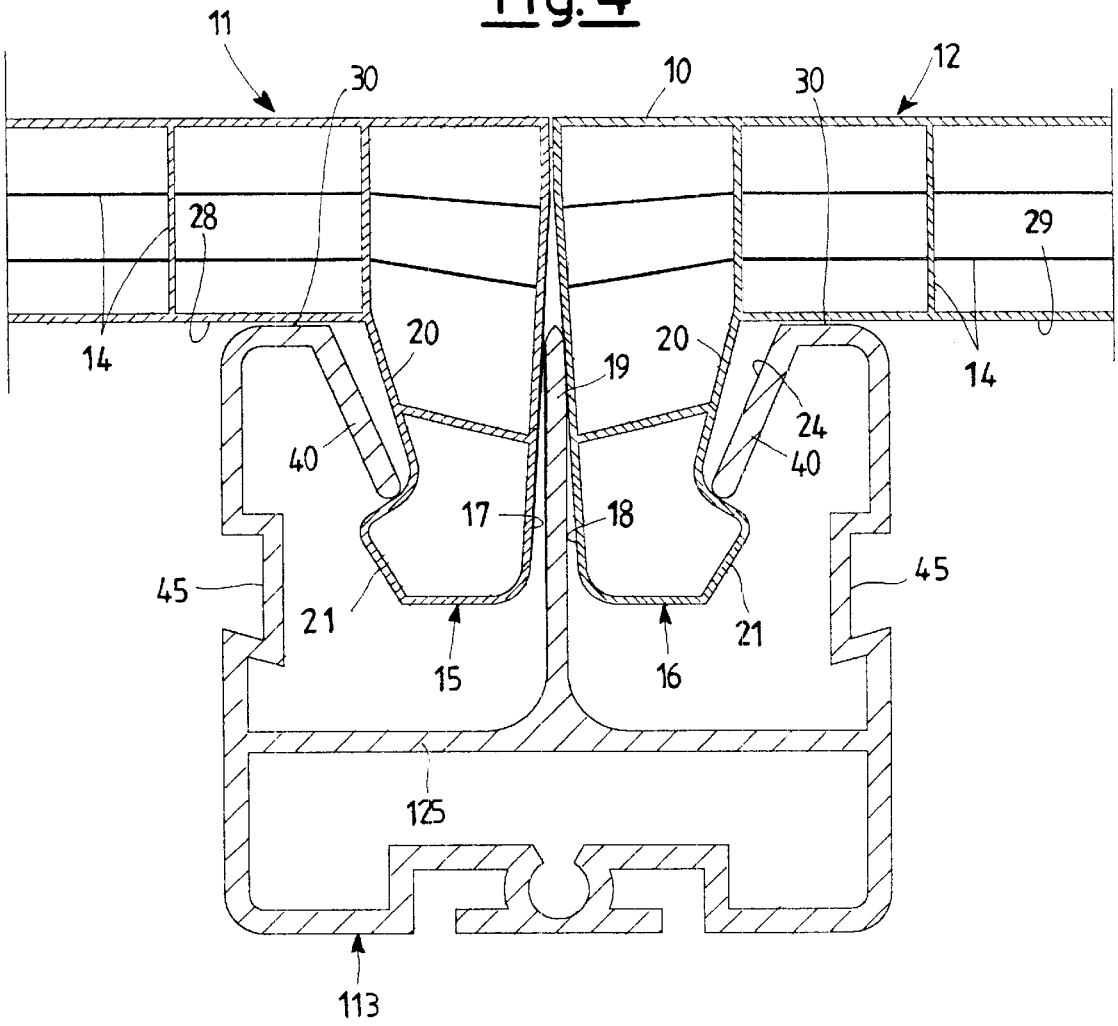
FIG. 4 shows a partial section view of a second embodiment of an assembly of panels and jointing element that realises the present invention, where the jointing element is made of aluminium extruded.
Figure 6:
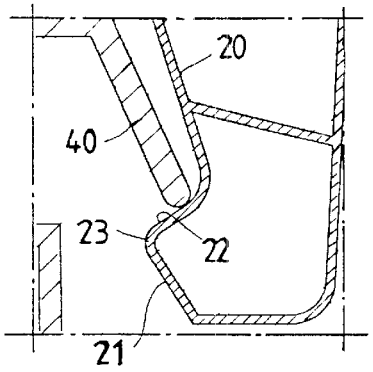
FIGS. 5 and 6 show sections of enlarged details of the assembly of FIG. 4.
Figure 5:
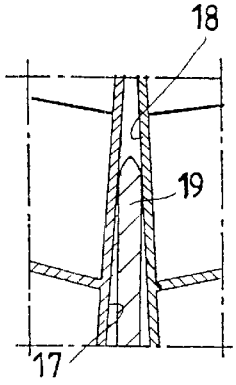

FIGS. 4–6 show a further second exemplification wherein the same reference numerals are used for equal parts, or optionally by adding a "1" for functionally similar parts.

The two panels 11 and 12 are identical to the previous ones, whereas the jointing element 113 is made of aluminium, alloys of the same material or similar material, for example realised through extrusion.

At the free end of the two side wings of the jointing element 113 there are realised inward curved extensions 40 whose ends 41 abut into housing 22 provided on extensions 15 and 16 of panels 11 and 12. Also said curved extensions 40 are provided with a rounded end 41 adapted to facilitate the sliding between the parts. Moreover, such curved extension 40 exhibits such inclination as to be similar to the inclined surface 24 and collaborate in sliding on the inclined surface portion 21 of extensions 15 and 16.

Also in this case there is present the pressing element 19, with conical shape and tapered at the tip, which facilitates its insertion between the two extensions 15 and 16 of two panels 11 and 12 and realises the coupling between the outside lateral surfaces 17 and 18 of panels 11 and 12.

Figure 7:
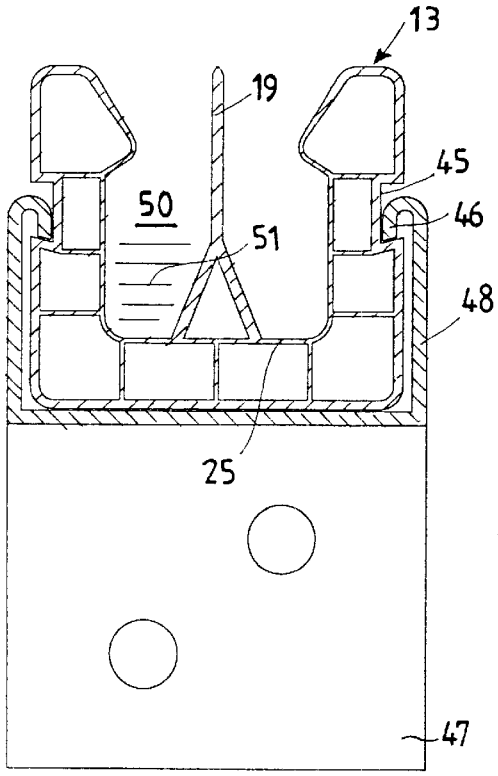
FIG. 7 shows a section view of the jointing element of FIG. 1 fastened to a metal plate for the connection to load bearing structures.
Figure 8:
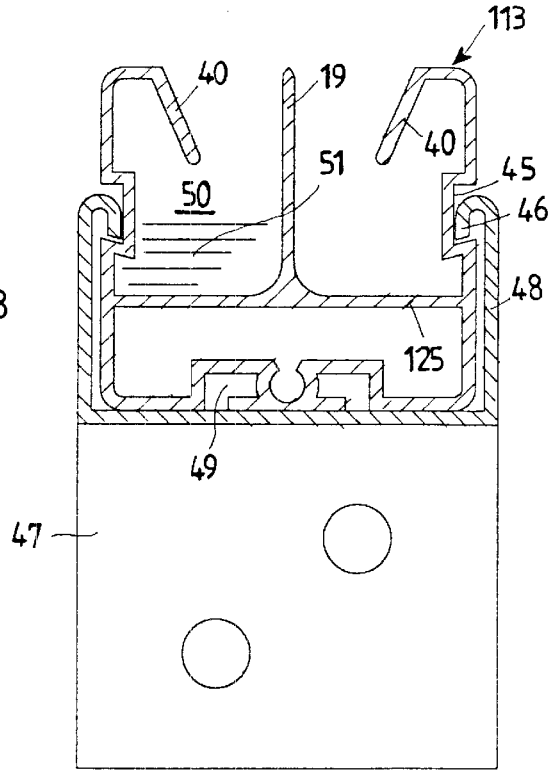
FIG. 8 shows a section view of the jointing element of FIG. 4 fastened to a metal plate for the connection to load bearing structures.
Figure 9:
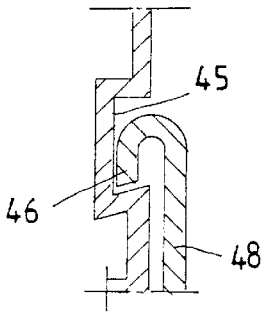
FIGS. 9 and 10 show sections of enlarged details of what illustrated in FIG. 8.
Figure 10:
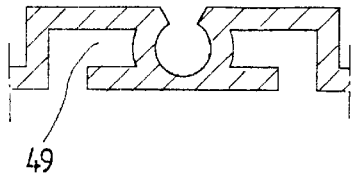

In both cases, depressions or recessed housings 45 can be provided on outside lateral walls of the jointing element 13 or 113, inside which it is possible to firmly insert hooks or hooking portions 46 that are arranged on arms 48 that extend between clamps or metal plates 47 for arranging the jointing element 13 (FIGS. 7 and 8). Such clamps 47 are used for the connection to load-bearing structures, and they laterally enclose and block, with the above hooking portions 46, the jointing element 13. This type of fastening through clamps is particularly useful in plane, curved roofing, or in very long vertical wall plugs.

Moreover, in FIG. 8 there is shown that, in the case of an aluminium extruded jointing element 13, it is possible to provide a dovetail coupling or housing 49 below a central base 125 of the jointing element 13.

In this way, it is possible to insert a stiffening profile, not shown, adapted to increase the performances of the entire assembly both in terms of load and of admissible free light.

Moreover, it must be pointed out that, although the pressing element 19 is provided into the jointing element 13 for guaranteeing the seal, in any case it has been though to consider the problem of infiltrations and of the water gathering arising from it.

For this purpose, wide areas or gathering chambers 50 (FIGS. 7 and 8) have been created in the jointing element 13, both made of polycarbonate or in aluminium, capable of housing the water, indicated in 51, which may accidentally infiltrate due to a seal defect.

The advantages that an assembly according to the present invention can exhibit are thus evident. Moreover, most of the disadvantages mentioned above are prevented.

For example, it must be noted that in the present invention, all the parts are rounded with inclined surfaces that facilitate their assembly.

Moreover, sharp portions of the teeth that could cause dangers in handling the elements of the assembly have been removed. Their construction is extremely simple, and their reciprocal arrangement does not exhibit any difficulty, although being extremely safe and firm.

The examples made relate to hollow embodiments of the panels and of the jointing element, but other embodiments are possible with curves with uprights and stiffeners realised through calendering of the assembly after forming. Such calendering of the assembly prevents any difficulty in assembling the panels and the jointing element.

What is claimed is:

1. A panel assembly for buildings which includes at least two panels (11, 12) and a joining element, wherein each panel (11, 12) comprises an alveolar cross-sectional structure, determined by a plurality of ribs (14) and arranged between two main outside surfaces (10, 28, 29), each panel having extensions (15, 16) that are provided at opposed ends of each panel (11, 12), and a joining element (13, 113) adapted to receive an extension (15, 16) for firmly engaging each of two adjacent panels (11, 12), characterized in that each extension (15, 16) and the joining element (13, 113) are provided with reciprocally engagable inclined surfaces (20, 21, 24, 27) facing inwards and facing each other, and in that said joining element (13) is U-shaped and is provided with a pressing element (19) that centrally extends from said joining element (13, 113) and is adapted for wedged engagement between outside facing walls (17, 18) of two extensions (15, 16).

2. A panel assembly according to claim 1, characterized in that said joining element (13) has a pair of wings each of which having rounded projections (26) at each end, which radially extend towards one another, said rounded projections (26) being adapted to interact with a respective rounded projection (23) positioned on said extensions (15, 16) of said panels (11, 12).

3. A panel assembly according to claim 2, characterized in that each of said projections (26) comprise a pair of converging elements having inclined surfaces (24, 27) that extend inwardly from said two wings of said U-shaped joining element (13).

4. A panel assembly according to claim 2, characterized in that said rounded projections (26) comprise a pair of essentially parallel inclined surfaces (20, 21) which are joined to form a housing (22) for said rounded projections (23).

5. A panel assembly according to claim 2, characterized in that pair of wings of said joining element (13, 113) include depressed or recessed housings (45) on outward facing surfaces, said recessed housings (45) being adapted to engage hooking portions (46) located on arms (48) which extend from clamps or metal plates (47) for attaching to said joining element (13) to a load-bearing structure.

6. A panel assembly according to claims 1, 2, 3, 4 or 5 characterized in that both of said panels (11, 12) and said joining element (13) are made of polycarbonate.

7. A panel assembly according to claim 6, characterized in that said panels (11, 12) are made of polycarbonate having an alveolar structure, and said joining element (113) is made of an aluminum extruded alloy.

8. A panel assembly according to claim 2, characterized in that each end of said pair of wings of said joining element (113) is made by extrusion, said ends of said pair of wings being shaped to define an inner curved extension (40) and having ends which are adapted to abut into a housing (21) provided on said extensions (15, 16) of said panels (11, 12).

* * * * *